United States Patent [19]

Shirahata et al.

[11] 4,354,908

[45] Oct. 19, 1982

[54] PROCESS FOR THE PRODUCTION OF MAGNETIC RECORDING MEMBERS

[75] Inventors: Ryuji Shirahata; Tatsuji Kitamoto; Yasuo Tamai; Masaaki Suzuki, all of Odawara, Japan

[73] Assignee: Fuji Photo Film Co., Ltd., Kanagawa, Japan

[21] Appl. No.: 923,752

[22] Filed: Jul. 11, 1978

Related U.S. Application Data

[63] Continuation of Ser. No. 688,192, May 20, 1976, abandoned.

[30] Foreign Application Priority Data

May 23, 1975 [JP] Japan ..... 50/61628

[51] Int. Cl.[3] ..... C23C 15/00

[52] U.S. Cl. ..... 204/192 N; 427/38; 427/42; 427/128; 427/132; 427/250; 427/296

[58] Field of Search ..... 427/127–132, 427/35–44, 48, 250, 296; 204/192

[56] References Cited

U.S. PATENT DOCUMENTS

| | | | |
|---|---|---|---|
| 3,329,601 | 7/1967 | Mattox | 204/298 |
| 3,342,632 | 9/1967 | Bate et al. | 117/217 |
| 3,342,633 | 9/1967 | Bate et al. | 117/217 |
| 3,516,860 | 6/1970 | Simmons | 117/236 |
| 3,898,952 | 8/1975 | Shirahata et al. | 118/49.1 |

OTHER PUBLICATIONS

Schuele, pp. 2558–2559, Communications, *Coercive Force of Angle of Incidence Films*, Feb. 1964.

JOAP, vol. 36, No. 3, Mar. 65, Speliotis et al., *Hard Magnetic Films of Iron, Cobalt and Nickel.*

Bunshah Nov.–Dec. 1972, J. Vac. Sci. Tech., vol. 9, No. 8 *The Influence . . . Deposition Process.*

*Primary Examiner*—Bernard D. Pianalto

*Attorney, Agent, or Firm*—Sughrue, Mion, Zinn, Macpeak & Seas

[57] ABSTRACT

A process for the production of a magnetic recording member which comprises effecting electric field vapor deposition under conditions such that the angle of incidence at which the vapor beam of a ferromagnetic metal strikes a support is at least about 50° and the electric field between the support and a vaporization source is at least about 5 kv/m.

8 Claims, 6 Drawing Figures

PROCESS FOR THE PRODUCTION OF MAGNETIC RECORDING MEMBERS

This is a continuation of application Ser. No. 688,192, filed May 20, 1976, now abandoned.

BACKGROUND OF THE INVENTION

1. Field of the Invention

The present invention relates to a process for the production of a magnetic recording member by an electric field vapor deposition, more particularly, to a process for the production of a magnetic recording member having excellent adhesion and good magnetic properties by an electric field vapor deposition.

2. Description of the Prior Art

Hitherto, coating type magnetic recording members in which a powdery magnetic material such as fine particles of $\gamma$-$Fe_2O_3$, Co-doped $\gamma$-$Fe_2O_3$, $Fe_3O_4$, Co-doped $Fe_3O_4$, Berthollide compounds of $Fe_2O_3$ and $Fe_3O_4$, or $CrO_2$, ferromagnetic alloys, or the like, is dispersed in an organic binder such as a vinyl chloride-vinyl acetate copolymer, a styrene-butadiene copolymer, an epoxy resin, a polyurethane resin, and the like, coated on a non-magnetic support, and then dried, have been widely used.

On the other hand, with recent increasing demands for high density recording, binderless magnetic recording members, in which a ferromagnetic metal thin film produced by vapor deposition such as a vacuum vapor deposition, sputtering, ion plating, etc., or by a plating such as electroplating, electroless plating, etc., is used as magnetic recording layers, that is, where no binder is used, have been attracting attention, and much effort is currently being directed to put such binderless magnetic recording members into practical use.

Since coating type magnetic recording members use, as magnetic materials, metal oxides having a lower saturation magnetization than ferromagnetic metals, the reduction in the thickness of the magnetic layer required for high density recording gives rise to a reduction in the signal output, and thus their uses are limited. Furthermore, such magnetic recording members have the drawbacks that their manufacture is complicated and large incidental equipment for solvent recovery or the prevention of pollution is required.

On the other hand, the binderless magnetic recording members have the advantages that a ferromagnetic metal having a higher saturation magnetization than oxides can be formed as a thin film in a state such that a non-magnetic material such as a binder is not present, thereby permitting the magnetic layer to be made thinner for high density recording; further, such can be manufactured by a simplified process.

Although binderless magnetic recording members where a ferromagnetic metal layer is provided as a magnetic recording layer are considered to be suitable for high density recording, particularly short wavelength recording, e.g., recording of short wavelengths reaching 1 $\mu$m such as video signals, it has been difficult to produce such magnetic recording members having magnetic properties as are required in magnetic recording members with a ferromagnetic metal layer which has good adhesion to a support and is resistant to relative movement against a magnetic head.

For instance, it is known that by a vacuum vapor deposition a magnetic film having excellent magnetic characteristics can be produced by striking the vapor beam of a ferromagnetic material obliquely upon the support (see, for example, U.S. Pat. Nos. 3,342,632 and 3,342,633; W. J. Schuele, *J. Appl. Phys.*, Vol. 35, 2558 (1964), D. E. Speliotis et al., *J. Appl. Phys.*, Vol. 36, 972 (1965), etc.). The inventors' experiments have revealed, however, that the use of conventional vacuum vapor deposition methods generally results in insufficient adhesion between the magnetic layer and the support, and that although the application of a glow discharge, etc., to the support prior to the vacuum vapor deposition slightly increases adhesion, the adhesive properties deteriorate upon increasing the angle of incidence of the vapor beam obliquely upon the support, and thus the magnetic recording member obtained is not practically usable.

On the other hand, as a method of obtaining a magnetic film having high adhesion, vapor deposition in a glow discharge as discovered by D. M. Mattox (see U.S. Pat. No. 3,329,601), i.e., ion plating, is known. This method, however, suffers from the defects that, since this method is carried out in the vacuum region in which the average free path of the vapor particles is small, and the vapor particles are accelerated by means of an electric field perpendicular to the surface of the support near the cathode and deposited on the support, there cannot be obtained the effect of increasing the magnetic properties as can be obtained by oblique vapor deposition.

SUMMARY OF THE INVENTION

The primary object of the present invention is to provide a process for the production of magnetic recording members which provides the effect of increasing magnetic characteristics through oblique vapor deposition and also provides a ferromagnetic metal thin film having excellent adhesion properties.

As a result of the inventors' research on the vapor deposition process in which a ferromagnetic metal is deposited from the gas phase onto a support, it has been found that electric field vapor deposition provides a ferromagnetic metal thin film having sufficient adhesion for use as a magnetic recording member, and, at the same time, makes it possible to achieve the effects of increasing magnetic properties by means of oblique vapor deposition as is known in conventional vacuum vapor deposition methods. That is to say, in conventional vacuum vapor deposition methods the adhesion properties of a magnetic film decreases with increasing the angle of incidence in effecting oblique vapor deposition to increase magnetic characteristics, whereas electric field vapor deposition at an electric field strength of not less than about 5 kv/m provides a ferromagnetic metal thin film of sufficient adhesion.

Accordingly, the above object is attained by effecting electric field vapor deposition under conditions such that the angle of incidence at which the vapor beam of the ferromagnetic metal strikes the support is at least about 50° and the electric field between the support and the vaporization source is at least about 5 kv/m.

DETAILED DESCRIPTION OF THE INVENTION

Figure 1:
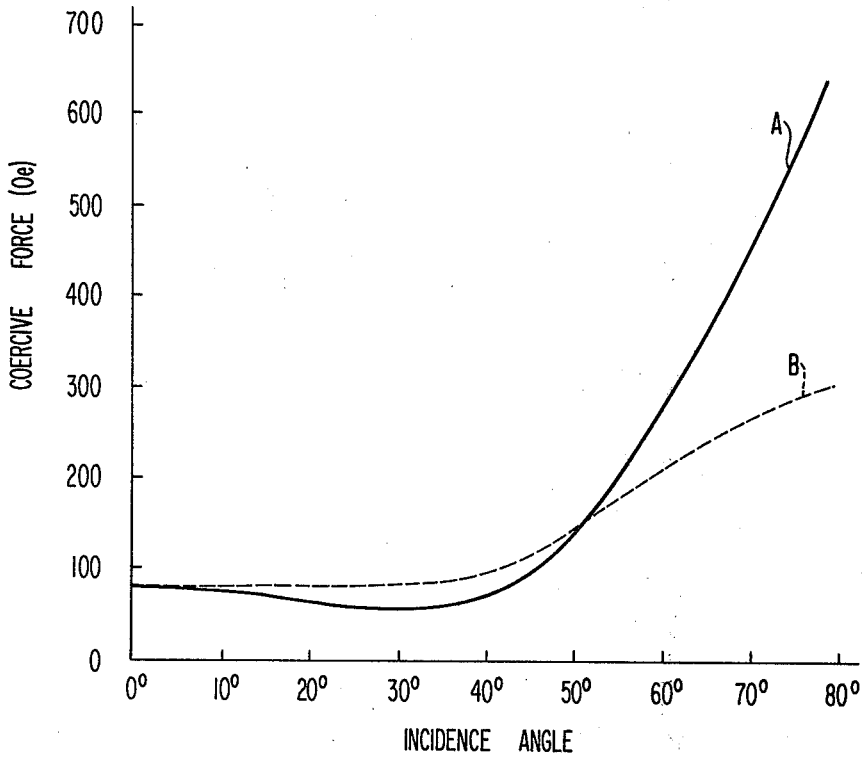
FIGS. 1 and 2 are graphs showing the magnetic characteristics of magnetic films produced by the method of the present invention.

The present invention provides a process for the production of magnetic recording members which comprises effecting electric field vapor deposition under conditions such that the angle of incidence at which the vapor beam of a ferromagnetic material strikes the surface of a support is at least about 50° and the electric field between the support and the vaporization source is at least about 5 kv/m.

The term "electric field vapor deposition" as is used herein designates the method in which a ferromagnetic metal is vaporized from a vaporization source at a reduced pressure of about $10^{-4}$ Torr to about $10^{-7}$ Torr, and, at the same time, some of the ferromagnetic metal vapor particles are ionized with an electron beam and deposited on the support which is negatively charged relative to the vaporization source, to thereby form a magnetic thin film thereon, i.e., ionized vapor particles are accelerated by the electric field generated between the vaporization source and support, and are deposited on the surface of the support, thereby forming a thin film. Further, a ferromagnetic metal may be vaporized from an electron beam vaporization source at a reduced pressure of about $10^{-4}$ Torr to about $10^{-7}$ Torr, and, at the same time, some of the ferromagnetic metal vapor particles are ionized by the same electron beam.

The term "angle of incidence" in the oblique vapor deposition designates the angle formed by the normal of the support and the vapor beam incident upon the support, and the term "incident plane" means the plane including the normal of the support and the incident vapor beam. Thus, assuming that support itself is horizontal, the angle of incidence would be measured from the vertical direction, and the incident plane would also be vertical.

In conventional vacuum vapor deposition methods, where the angle of incidence is more than about 60°, magnetic anisotropy is formed in a direction parallel to the incident plane and a high coercive force is exhibited in this direction. It has been found, however, that in the electric field vapor deposition process, magnetic anisotropy is formed by an oblique vapor deposition, and, in this case, there is an easy magnetization axis in a direction parallel to the incident surface.

The coercive force increases with increasing the angle of incidence, and, thus, it is necessary from the viewpoint of the use of the magnetic recording member that the incident angle be at least about 50°. Below 60°, however, the coercive force is not necessarily sufficient for some purposes, and above 80°, the efficiency of deposition decreases. Thus, it is desired to set the angle of incidence in the range of 60° to 80°.

It is also observed that the adhesion properties of the ferromagnetic metal thin film increases with increasing strength of the electric field, and this tendency becomes more remarkable upon increasing the angle of incidence. In general, it is sufficient from the practical point of view if the strength of the electric field is at least about 5 kv/m, but if more increased adhesion is desired, it is preferred to apply an electric field of 8 kv/m to 30 kv/m. Where the strength of the electric field is above 30 kv/m, the rate of deposition decreases due to ion bombardment, which is not economical. Generally, in conducting the electric field vapor deposition of the present invention the support is maintained at a temperature of from about room temperature to about 150° C., and the vapor deposition is conducted at a rate of from about 5 to about 500 Å/sec.

The supports utilized in the present invention are non-magnetic supports. Examples of the same include cellulose derivatives such as cellulose acetate, nitrocellulose, ethyl cellulose, methyl cellulose, etc., polyamides such as nylon-6,6, nylon-6, etc., acrylic acid derivatives such as polymethyl methacrylate, etc., fluorohydrocarbons such as polytetrafluoroethylene, polytrifluoroethylene, etc., polymers or copolymers of α-olefins such as ethylene, propylene, etc., polymers or copolymers of vinyl chloride and/or vinylidene chloride, polycarbonates, polyimides, polyesters such as polyethylene terephthalate, polyethylene naphthalate and the like. The support can be arbitrarily selected from such materials at a thickness as desired, depending upon the end use purpose. For example, the support can vary from the order of microns in thickness to centimeters in thickness.

In addition, metals such as aluminum, alloys thereof, for example, an alloy of 96 wt % Al and 4 wt % Cu, brass, beryllium, copper, stainless steel, etc., or inorganic materials such as glass, ceramics, and the like can be used. The shape of the support may be any of a tape, sheet, card, disc, and like shapes.

Where a magnetic material is deposited by electric field vapor deposition on an electrically non-conductive support, it is possible to carry out the electric field vapor deposition as with an electrically conductive support by bringing the support in close contact with a cathode plate or by placing a cathode of grid form opposite the vaporization source above the support.

Ferromagnetic materials which can be used in the present invention include iron, cobalt, nickel, and other ferromagnetic metals. Preferred ferromagnetic materials include at least 50 wt % of the ferromagnetic metal which is a transition metal which is at least one member selected from Fe, Co, Ni, i.e., Fe, Co, Ni, Fe-Co, Fe-Ni, Co-Ni, Fe-Si, Fe-Rh, Fe-V, Fe-Cu, Fe-Au, Co-P, C-V, Co-Si, Co-Y, Co-La, Co-Ce, Co-Pr, Co-Sm, Co-Mn, Co-Pt, Ni-Cu, Co-Ni-Fe, Co-Ni-Ag, Co-Ni-Zn, Co-Si-Al, Fe-Si-Al, or 41.5 to 62.5 atom % of the ferromagnetic metal when it is Mn, i.e., Mn-Bi, Mn-Sn-Mn-Al, Co-Mn and the like. The materials disclosed in U.S. Pat. Nos. 3,516,860 and 3,898,952 can also be utilized.

The magnetic thin film of the present invention should have a thickness capable of providing a sufficient output as a magnetic recording member and a thinness capable of effecting sufficient high density recording. Thus, in general, the thickness is about 0.05 μm to about 2.0 μm, preferably 0.1 μm to 0.4 μm.

The apparatus utilized to practice the present invention is conventional. See, for example, R. F. Bunshan and R. S. Juntz, *Journal of Vacuum Science Technology*, Vol. 9, p. 1404 et seq. (1972).

The present invention makes it possible to produce magnetic recording members carrying a ferromagnetic metal thin film which has excellent adhesion properties and good magnetic characteristics, by means of the electric field vapor deposition process.

The present invention will be illustrated in more detail by reference to the following Examples, but it should not be construed as limited thereto.

EXAMPLE 1

Iron having a purity of 99.99% was charged into the boat of a 270° reflection type electron beam evaporation source and a 25 μm thick polyethylene terephthalate film as a support was brought into contact with a cathode plate made of copper and fixed thereto. This cathode plate was so designed that it could be placed at various angles relative to the vaporization source whereby electric field vapor deposition could be carried out at various incident angles.

Figure 2:
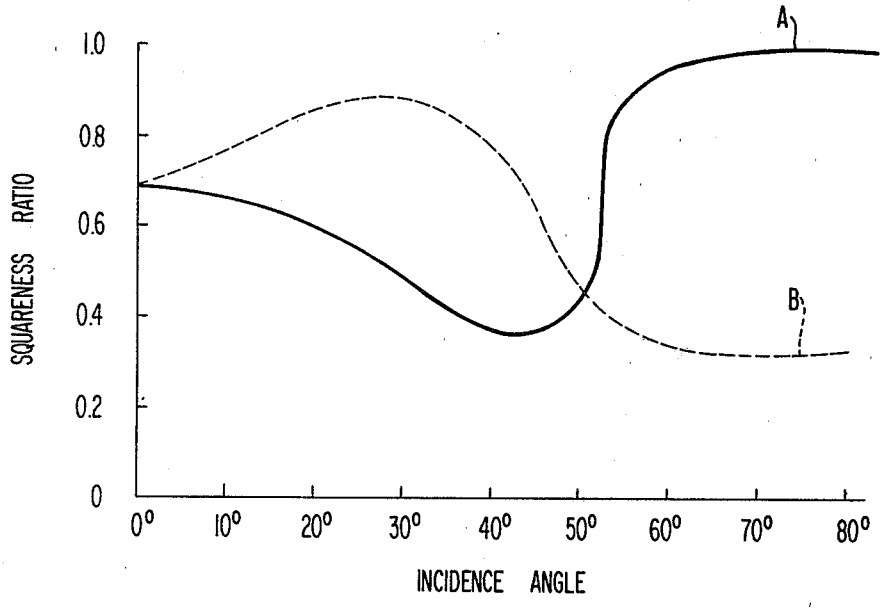

The relationship between the magnetic characteristics and the angle of incidence when the electric field vapor deposition was conducted while applying an electric field of 12 kv/m is shown in FIGS. 1 and 2. In this case, the thickness of the magnetic film was 0.12 μm. During the electric field vapor deposition, the vacuum was maintained at $2\times10^{-5}$ Torr, and the vapor deposition rate was 20 Å/sec.

FIG. 1 shows the relationship between coercive force and angle of incidence, and FIG. 2 shows the relationship between squareness ratio and angle of incidence, in each of which Curve A indicates the values when the external magnetic field was applied parallel to the incident plane and Curve B indicates the values when the external magnetic field was applied perpendicularly to the incident plane.

As is apparent from FIGS. 1 and 2, magnetic anisotropy is induced by the oblique incidence vapor deposition, and where the vapor deposition was effected at an angle of incidence of at least about 50°, a film was obtained which had an easy magnetization axis in a direction parallel to the incident plane and had good magnetic characteristics.

Figure 4:
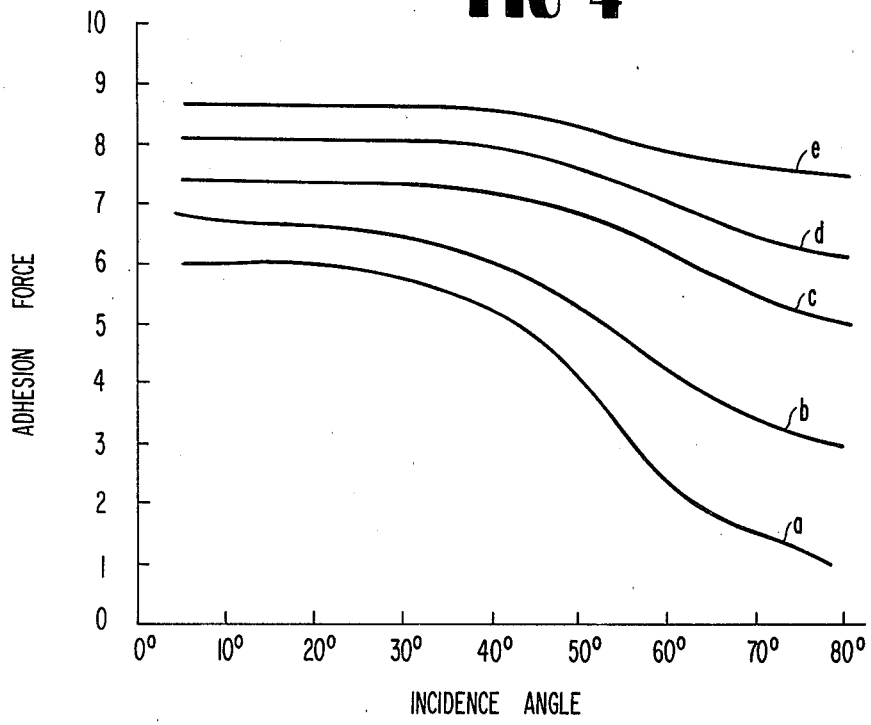
FIG. 4 is a graph showing the adhesion force of each of magnetic films produced by the method of the present invention and a prior art method.

The adhesion force of a magnetic thin film produced by effecting electric field vapor deposition in which the strength of the electric field was changed was then measured by the adhesive cellophane tape peeling test, i.e., adhesive cellophane tape is pressed onto the deposited film and then stripped off. The adhesion is estimated by the amount of metal layer (or film) removed from the film. FIG. 4 shows the relationship between the adhesion force and the angle of incidence with the strength of electric field as a parameter, in which Curves b, c, d, and e were obtained, respectively, at an electric field of 3, 6, 9, and 12 kv/m. With regard to the adhesion force, the results of the adhesive cellophane tape peeling test were classified in 10 ranks, and in each case, the average value of 5 samples was plotted. The larger the number is, the higher the adhesion force is, and those members having a value of not less than 6 are practically usable as magnetic recording members.

As is apparent from FIG. 4, in the electric field vapor deposition the adhesion force increases with increasing strength of the electric field, and, in particular, in the case of high incident angles, the effect is remarkable. In more detail, the electric field vapor deposition film produced at an angle of incidence of not less than about 50° so as to have the desired magnetic characteristics as a magnetic recording member exhibits a practically usable adhesion force when vapor deposited at an electric field of not less than about 5 kv/m.

COMPARISON EXAMPLE 1

Using a high frequency induction heating type evaporation source in place of the 270° reflection type electron beam evaporation source, iron was vapor deposited on a polyethylene terephthalate film in the same manner as in Example 1. In this example, no electric field was applied, i.e., a conventional vacuum vapor deposition was conducted.

Figure 3:
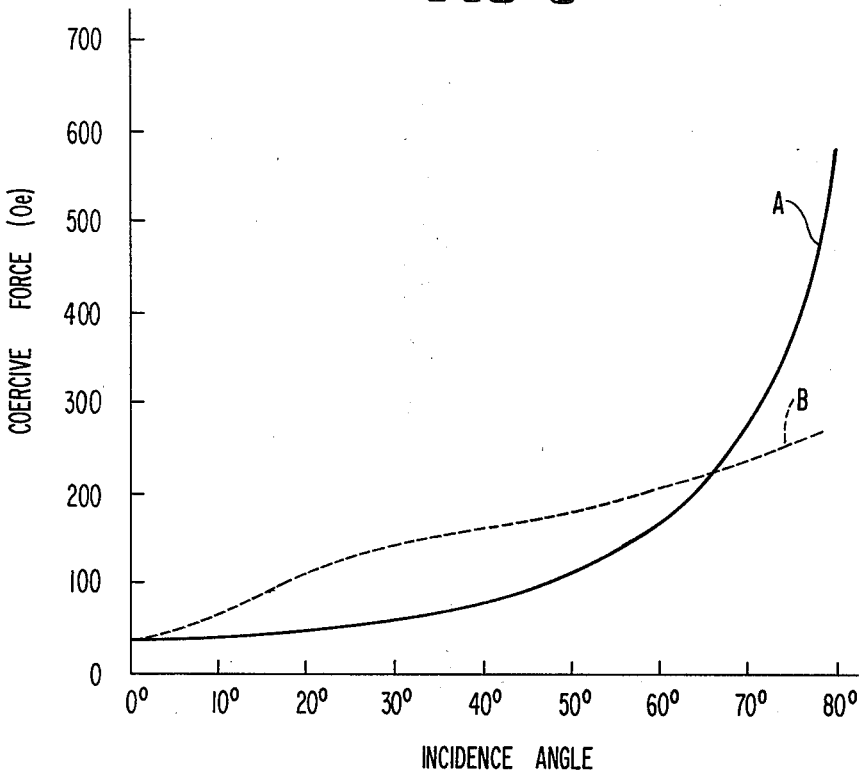
FIG. 3 is a graph showing the magnetic characteristics of a magnetic film produced by a conventional vacuum vapor deposition method.

FIG. 3 shows the relationship between the coercive force and angle of incidence for the Comparison Example when the oblique vapor deposition was conducted, in which Curves A and B show the results when the external magnetic field was applied, respectively, parallel or perpendicular to the incident plane. When the vapor deposition was conducted at an angle of incidence of not less than 65°, there was obtained a film having an easy magnetization axis in both the incident plane and the parallel direction.

Curve a of FIG. 4 shows the relationship between the adhesion force and the angle of incidence.

The conventional vacuum vapor deposition failed to provide a magnetic film having practical usable magnetic charactertistics and adhesion force.

EXAMPLE 2

The electric field vapor deposition was conducted in the same manner as described in Example 1 but using a Co-V alloy (V content: 10% by weight), in place of iron and using a 25 μm polyimide film as a support.

Figure 5:
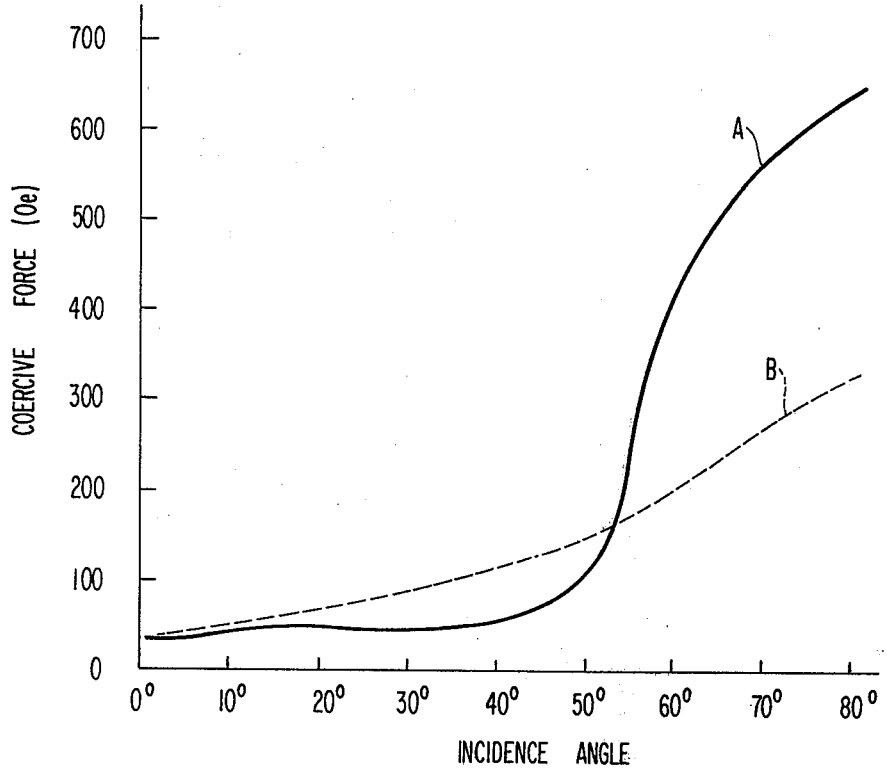
FIGS. 5 and 6 are graphs showing the magnetic characteristics and adhesion force of a magnetic film produced by the method of the present invention.

FIG. 5 shows the relationship between the coercive force and the angle of incidence when the electric field vapor deposition was conducted while applying an electric field of 8 kv/m, in which Curves A and B show the results when the external magnetic field was applied, respectively, parallel or perpendicular to the incident plane. In this case, the thickness of the magnetic film was 0.10 μm. During the electric field vapor deposition, the degree of vacuum was maintained at $1\times10^{-6}$ Torr and the vapor deposition rate was 60 Å/sec.

As can be understood from FIG. 5, the effect of the oblique vapor deposition was obtained in the electric field vapor deposition, and a magnetic film having good magnetic characteristics was obtained at about 50° or more.

Figure 6:
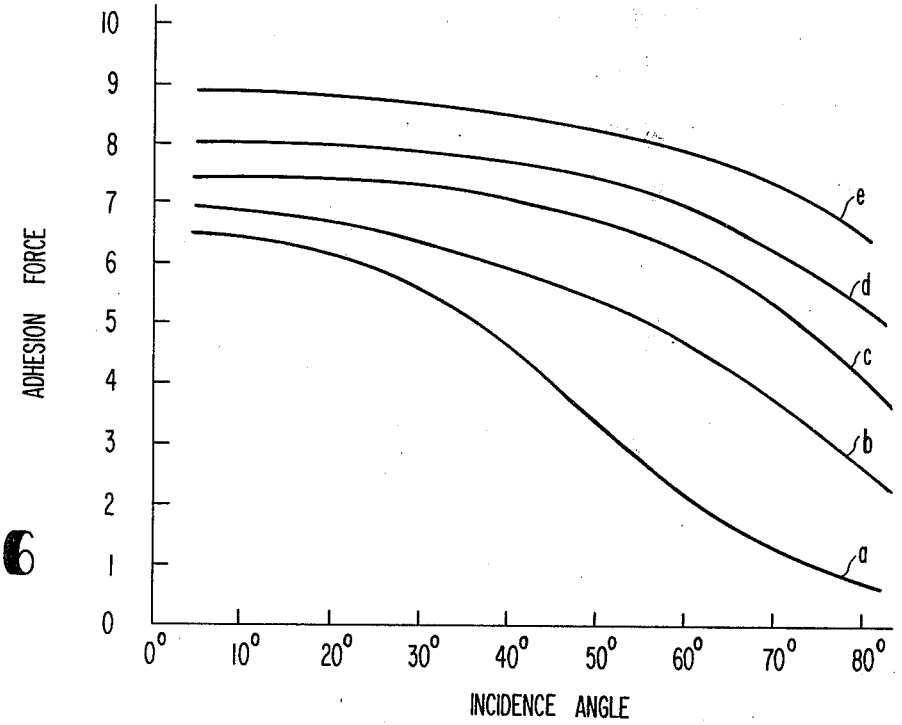

FIG. 6 shows the relationship between the adhesion force and the angle of incidence when the strength of the electric field was changed. The same method of measuring adhesion force as was used in Example 1 was used. Curves a, b, c, d, and e show the results when an electric field of 0, 2, 5, 8, and 11 kv/m was applied, respectively.

As is apparent from these results, a magnetic film produced by effecting electric field vapor deposition at an angle of incidence of not less than about 50° and at an electric field of not less than about 5 kv/m has good magnetic characteristics and, at the same time, has an adhesion force practically usable as a magnetic recording member.

As described above, in conventional vacuum vapor deposition, oblique vapor deposition leads to a reduction of adhesion force and the magnetic recording member obtained is less practically usable. In the electric field vapor deposition of the present invention, however, the oblique vapor deposition increases the magnetic characteristics, and, furthermore, an improvement in adhesion properties can be obtained.

While the invention has been described in detail and with reference to specific embodiments thereof, it will be apparent to one skilled in the art that various changes and modifications can be made therein without departing from the spirit and scope thereof.

What is claimed is:

1. A process for producing a magnetic recording member, comprising the steps of:

generating ferromagnetic metal vapor particles from a vaporization source in a reduced pressure of about $10^{-4}$ Torr to about $10^{-7}$ Torr;

ionizing said ferromagnetic vapor particles by means of an electron beam; and accelerating said ionized ferromagnetic metal vapor particles, by means of an electric field between said vaporization source and a support having a field strength of at least about 5 kv/m, toward said support to form a vapor beam which has an angle of incidence of at least about 50° with respect to said support, thereby producing a magnetic film on said support.

2. The process according to claim 1, wherein the angle of incidence of the vapor beam of a ferromagnetic metal is from 60° to 80°.

3. The process according to claim 2, wherein the electric field strength between the support and the vaporization source is 8 kv/m to 30 kv/m.

4. The process according to claim 1, wherein the ferromagnetic metal is selected from the group consisting of iron, nickel, cobalt, other ferromagnetic metals and magnetic alloys.

5. The process according to claim 1, wherein the thickness of the magnetic film produced is about 0.05 μm to about 2.0 μm.

6. The process according to claim 1, wherein said generating and ionizing steps are performed by the same electron beam.

7. The improvement of claim 1 wherein said support is maintained at a temperature from room temperature to about 150° C.

8. The improvement of claim 1 wherein the vapor deposition occurs at a rate of from about 5 to about 500 Å/sec.

* * * * *